United States Patent [19]

Ferris et al.

[11] Patent Number: 4,563,011

[45] Date of Patent: Jan. 7, 1986

[54] BOARD GAME

[75] Inventors: Michael J. Ferris, Chicago; Wayne A. Kuna, Oak Park, both of Ill.

[73] Assignee: Marvin Glass & Associates, Chicago, Ill.

[21] Appl. No.: 563,095

[22] Filed: Dec. 19, 1983

[51] Int. Cl.[4] ..... A63F 3/00

[52] U.S. Cl. ..... 273/243; 273/288; 273/289; 446/470

[58] Field of Search ..... 273/289, 254, 255, 262, 273/243; 446/465, 450, 470, 464

[56] References Cited

U.S. PATENT DOCUMENTS

| | | | |
|---|---|---|---|
| 3,708,168 | 1/1973 | Strader et al. | 273/16 |
| 4,291,884 | 9/1981 | Bass et al. | 273/249 |
| 4,343,476 | 8/1982 | Engel et al. | 273/289 |

FOREIGN PATENT DOCUMENTS

| | | | |
|---|---|---|---|
| 1090757 | 4/1955 | France | 273/254 |
| 1147834 | 11/1957 | France | 446/465 |
| 2069345 | 8/1981 | United Kingdom | 273/255 |

*Primary Examiner*—Richard C. Pinkham
*Assistant Examiner*—Scott Brown
*Attorney, Agent, or Firm*—John S. Pacocha

[57] ABSTRACT

A board game with a board is divided into a grid work of road and off-road rough terrain spaces. Each player is provided with a colored paired "BIG FOOT" truck and a crushable car. The object of the game is to land on opponents' crushable cars with the truck. A shift lever on the truck indicates whether it is in "Two-Wheel Drive" for road moves, or "Four-Wheel Drive" for rough terrain or landing on an opponent's crushable car. Each turn may include any combination of truck and/or crushable car moves plus shifting of the truck between "Two-Wheel" and "Four-Wheel". The number of moves to be made by a player is determined by rolling dice.

15 Claims, 8 Drawing Figures

BOARD GAME

BACKGROUND OF THE INVENTION

1. Field of the Invention

This invention relates generally to board games and more particularly to board games that embody a theme suggested by other media or events.

2. Background Art

Board games, particularly those based on various themes suggested by events, occurrences, entertainment, or personalities in real life have long been popular. For example, prior art United States patents assigned to the assignee of the present invention disclose board games embodying themes of: a beauty contest, U.S. Pat. Nos. 3,861,686; golf, 3,989,249; and the legendary creature "BIG FOOT", 4,128,246. There remains a need for board games that provide entertaining, challenging and competitive play and which employ a theme suggested by current happenings. Recently, the "BIG FOOT" truck, which in some appearances drives over and crushes the tops of cars, has become a "personality". In addition, a scaled-down version of the full size "BIG FOOT" truck, which is shiftable between "Two-Wheel" and "Four-Wheel" drive has become a popular toy.

SUMMARY OF THE INVENTION

The present invention is concerned with providing a board game for two to four players based on the "BIG FOOT" vehicle and which affords each player an opportunity to crush the opponents' cars while trying to keep the player's own car from being crushed by the opponents. These and other objects and advantages of the invention are achieved by providing a game board divided into a grid work of road spaces and off-road rough terrain spaces. Each player may traverse either type of space with a "BIG FOOT" vehicle token. A movable shift indicator is provided on the "BIG FOOT" vehicle tokens for indentifying upon which type of space the player may move the token. In addition to a "BIG FOOT" truck token, each player is provided with a crushable hollow shell made of a soft elastic material in a shape of a car, plus a number of counter cards. The "BIG FOOT" vehicle, crushable car, and counters of each player are distinguished by a color different from those of the opponents. A turn consists of a number of moves determined by a die roll which the player may allocate between moves of the truck and car tokens. Shifting the truck between two and four wheel drive counts as one of the moves. When a player's car is crushed by an opponent's truck, the player must surrender a counter card. The first player to crush three cars other than his own is the winner.

BRIEF DESCRIPTION OF THE DRAWING

For a better understanding of the present invention reference may be had to the accompanying drawing in which.

DETAILED DESCRIPTION OF THE PREFERRED EMBODIMENT

Figure 1:
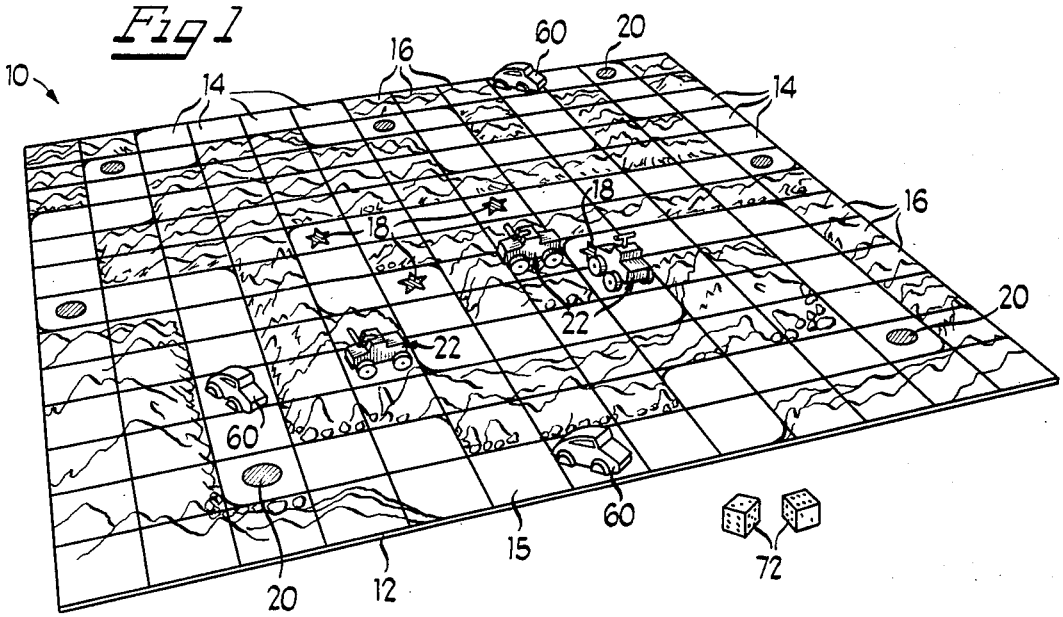
FIG. 1 is a perspective view of an embodiment of the present invention in the course of play.

Referring now to the drawing in which like parts are designated by like reference numerals throughout the severals views, there is shown in FIG. 1 a board game 10 which includes a game board 12. Within the boundaries defined by the outer periphery of the game board there is a grid work of spaces. Board 12 is conveniently square and divided into thirteen spaces along each side. The one hundred and sixty-nine grid work spaces are divided into seventy road spaces 14 and ninety-nine off-road rough terrain spaces 16. In the embodiment shown, the rough terrain spaces 16 are defined by graphic representations of mountainous terrain. However, a three dimensional texture could be employed to differentiate the on-road and off-road spaces. Contiguous spaces 14 form a single space wide tortuous path or road 15 through the mountainous terrain spaces 16. Along the road 15, four interior spaces are designated by means of a star 18 while eight spaces nearer the periphery are designated by means of a circle 20.

Figure 2:
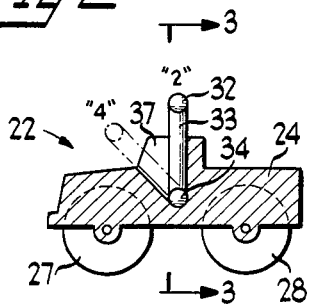
FIG. 2 is an enlarged scale, vertical sectional view of a truck token.
Figure 3:
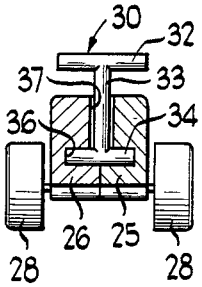
FIG. 3 is a sectional view taken generally along the line 3—3 of FIG. 2.
Figure 4:
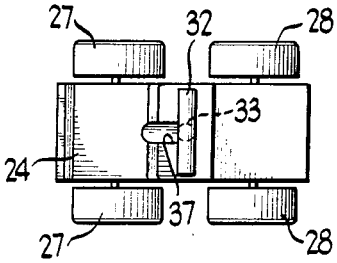
FIG. 4 is a top plan view of the truck token.
Figure 6:
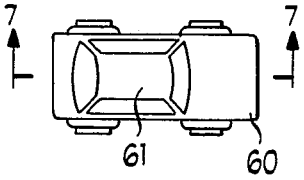
FIG. 6 is an enlarged scale top plan view of a crushable car token.

Each player is provided with a "BIG FOOT" truck or vehicle token 22 which comprises a pick-up type truck body 24 formed of mating halves 25 and 26 mounted on a pair of front wheels 27 and a pair of rear wheels 28. A shift lever 30 is provided to indicate whether the "BIG FOOT" token is in "Two-Wheel" or "Four-Wheel" drive. As is best illustrated in FIG. 3, the shift lever 30 may be made in the general shape of an "I" with an upper generally horizontal bar 32, a generally vertical bar 33, and a lower generally horizontal bar 34. The lower bar 34 is received in a generally, centrally disposed, transverse horizontal bore 36 formed in the mating halves 25 and 26 of the vehicle body. An elongated slot 37 receives the vertical bar 33 for back and forth pivotal movement of the shift lever 30 about the lower horizontal bar 34. Accordingly, when the shift lever 30 is in the generally vertical position shown in FIG. 2 and designated by "2", the truck token 22 is in "Two-Wheel" drive, and when lever 30 is in the forwardmost position shown in phantom in FIG. 2 and designated by "4", the truck token is in "Four Wheel" drive.

Figure 5:
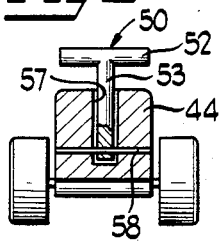
FIG. 5 is a sectional view of an alternative embodiment of a truck token similar to that of FIG. 3.
Figure 8:
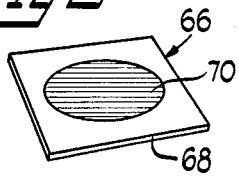
FIG. 8 is an enlarged scale perspective view of a counter card.

As an alternative, the truck token 22 may, as shown in FIG. 5, be formed of a one-piece body 44 and receive a "T" shift lever 50 for pivotal movement similar to "I" 30. In such an alternative, the shift lever 50 has an upper horizontal bar 52 and a depending generally vertical bar 53. The vertical bar 53 is received in the chassis 44 for back and forth pivotal movement in a slot 57 and is mounted for such pivotal movement by means of a pin 58 that extends through the lower end of the bar 53 and into the chassis 44.

Figure 7:
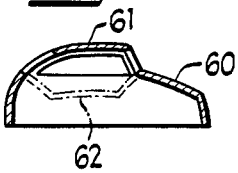
FIG. 7 is a sectional view taken generally along the line 7—7 of FIG. 6.

In addition to a truck token 22, each player is provided with a crushable vehicle token 60. The crushable token may be molded of latex or other elastic material as a relatively thin-walled hollow shell in any convenient car body shape having a roof 61. A downward force on the roof deforms it to crushed position 62, illustrated in the phantom in FIG. 7. Once the force is removed the crushed car token 60 resumes its prior uncrushed shape. Each player is also provided with a number, conveniently three, of crushed car tokens 66 comprising a card 68 with a representation of a flattened or crushed blob of metal 70. The representation 70, as well as the crushable car token 60 and the "BIG FOOT" truck 22, are all identified by the same color to distinguish the tokens and counters of one player from those of the opponents. For convenience of illustration, the game is shown in FIG. 1 in play by three players although it is also intended for two or four players. A set of dice 72 are provided for determining the number of moves each player may make in a particular turn.

At the onset, each player's "BIG FOOT" token 22 is placed upon a star starting space 18. The stars 18 may also be colored coded so that once a player selects his color the starting position is determined. In addition to placing the token 22, each player places the color paired crushable car token 60 on a selected circle space 20. Once one player's crushable car token 60 is placed on a circle 20, another player may not occupy the same space. The object is for each player to move the assigned "BIG FOOT" token 22 about the board to crush three of the car tokens 60 belonging to other players. After a player crushes an opponent's car token 60, the player collects a counter 66 from that opponent and the opponent then returns the car token 60 to a selected open circle space 20. Should the token 60 of one player be crushed for a fourth time and no opponent has yet obtained three counters, the player merely removes the crushable car token 60 and continues to play until the game is won.

In order to move the truck token 22 on the road spaces 14 the vehicle must be in "Two-Wheel" drive. For off-road movement in the rough terrain spaces 16 or to crush a car token 60, the token 22 must be in "Four-Wheel" drive. Shifting between "Two-Wheel" and "Four-Wheel" drive counts as a move. Both the truck tokens 22 and car tokens 60 may move in either forward or reverse. When either vehicle makes a right angle corner turn it counts as one move. Upon encountering an opponent's truck token 22, the opponent's truck may be pushed if the player's truck is in "Four-Wheel" drive. If the opponent's token 22 is pushed off the board, the opponent's token must then be returned to an interior starting space indicated by a star 18.

While a particular embodiment of the present invention has been shown and described with some alternatives, other changes and modifications will occur to those skilled in the art. It is intended in the following claims to cover all such changes and modifications as fall within the true spirit and scope of the present invention.

What is claimed as new and desired to be secured by Letters Patent is:

1. A board game for two to four players comprising:

a game board divided into a grid work of spaces including a plurality of first and a plurality of second spaces;

each of the first spaces being contiguous with more than one and less than three of the other first spaces and having graphic indicia defining a contiguous, single space wide, tortuous road including generally parallel portions;

each of the second spaces having graphic representations of rough, off-road terrain;

generally parallel portions of the road being separated from each other by one or more of the second spaces;

a first token for each player including means distinguishing each player's first token from the first token of each other player movable upon the spaces;

means on the board designating a different starting space for the first token of each of the players;

the first token representing a four wheel drive vehicle and having shiftable indicator means for designating whether the first token is in "two wheel" drive for movement upon the first spaces or is in "four wheel" drive for movement upon the second spaces;

a second movable token for each player including means distinguishing each player's second token from the second token of each other player selectively placeable upon one of the first spaces;

means on at least four preselected ones of the first spaces designating the preselected ones as a starting space for a second token;

the second token representing a car and including means for alternatively representing an uncrushed car or a crushed car; and chance means for determining the number of moves a player may make in a turn.

2. The board game of claim 1 in which the indicator means comprises a pivotally mounted shift lever.

3. The board game of claim 2 in which:

the shift lever is generally "T" shaped;

a generally vertically disposed slot extends along the middle of the first vehicle from adjacent the rear to adjacent the front of the first vehicle; and pin means extending through the bottom of the "T" mounts the shift lever for pivotal movement in the slot.

4. The board game of claim 2 in which:

the shift lever is generally "I" shaped;

a generally horizontally disposed slot is positioned approximately in the middle of the first vehicle;

a generally vertical disposed slot intersects the horizontally disposed slot; and the lower horizontal bar of the "I" shaped shift lever is trapped in the horizontal disposed slot with the vertical bar of the "I" extending out through the vertically disposed slot for pivotal movement about the lower horizontal bar.

5. The board game of claim 1 in which the second token is a relatively thin walled hollow shell formed of an elastic material such that the second token may be crushed by exertion of a force upon the second token but will regain its original shape upon removal of the force.

6. The board game of claim 5 including counter means for recording the number of times a second token has been crushed.

7. The board game of claim 1 in which the first and second tokens are paired by indicia means.

8. The board game of claim 7 in which the indicia means are colored.

9. The board game of claim 1 in which the means designating preselected ones of the first spaces as a starting space for a second token are also on an additional four preselected ones of the first spaces.

10. A board game for two to four players comprising:

a game board divided into a grid work of spaces including a plurality of first and a plurality of second spaces;

each of the first spaces being contiguous with two of the other first spaces and having graphic indicia defining a contiguous, tortuous path including generally parallel portions;

each of the second spaces having graphic representations distinguishing it from the first spaces;

generally parallel portions of the path being separated from each other by one or more of the second spaces;

a movable attack token and a movable target token for each player including means distinguishing each player's tokens from the tokens of each other player;

means on the board designating a different starting space for the attack token of each of the players;

means on at least four preselected ones of the first spaces designating the preselected ones as a starting space for a target token;

the attack token including shiftable indicator means for designating whether the attack token is in a first mode for movement upon the first spaces or is in a second mode for movement upon the second spaces;

the target token including means for alternately representing an uncrushed target or a crushed target; and chance means for determining the number of moves each player may make in a turn.

11. The board game of claim 10 in which the target token is a relatively thin walled hollow shell formed of an elastic material such that the target token may be crushed by placing the attack token upon the target token and so that the target token will regain its original shape upon removal of the attack token.

12. The board game of claim 10 in which the movable attack token and the movable target token for each player are paired by color indicia.

13. The board game of claim 10 in which the movable attack token represents a four wheel drive vehicle and the shiftable indicator means comprises a pivotally mounted shift lever for designating whether the vehicle is in a "two wheel drive" first mode or a "four wheel drive" second mode.

14. The board game of claim 13 in which the target token represents a car.

15. The board game of claim 10 in which the means designating preselected ones of the first spaces as a starting space for a target token are also on an additional four preselected ones of the first spaces.

* * * * *